US005601192A

United States Patent [19]

Hutzler et al.

[11] Patent Number: 5,601,192

[45] Date of Patent: Feb. 11, 1997

[54] PRESSURE SORTER FOR FIBER SUSPENSIONS

[75] Inventors: Wilhelm H. Hutzler, Reutlingen; Erich Czerwoniak, Pfullingen, both of Germany

[73] Assignee: Hermann Finckh Maschinenfabrik GmbH & Co., Pfullingen, Germany

[21] Appl. No.: 351,329

[22] PCT Filed: Jun. 20, 1992

[86] PCT No.: PCT/EP92/01393

§ 371 Date: Dec. 12, 1994

§ 102(e) Date: Dec. 12, 1994

[87] PCT Pub. No.: WO94/00634

PCT Pub. Date: Jan. 6, 1994

[51] Int. Cl.[6] ..... B07B 1/04; B07B 1/52

[52] U.S. Cl. ..... 209/273; 209/300; 209/389; 210/413

[58] Field of Search ..... 209/273, 274, 209/281, 283, 300, 379, 385, 389; 210/413, 414, 415

[56] References Cited

U.S. PATENT DOCUMENTS

| | | | |
|---|---|---|---|
| 3,400,820 | 9/1968 | Nelson | 209/273 |
| 3,581,903 | 6/1971 | Holz | 210/415 |
| 3,680,696 | 8/1972 | Morin | 209/273 X |
| 3,726,401 | 4/1973 | Bolton, III et al. | 210/415 X |
| 3,912,622 | 10/1975 | Bolton, III et al. | 209/273 X |
| 3,964,996 | 6/1976 | Holz et al. | 209/273 X |
| 4,043,919 | 8/1977 | Hutzler | 210/414 X |
| 4,155,841 | 5/1979 | Chupka et al. | 210/415 X |
| 4,200,537 | 4/1980 | Lamort | 210/415 |
| 4,276,159 | 6/1981 | Lehman | 209/273 |
| 4,410,424 | 10/1983 | Chupka et al. | 209/273 |
| 4,529,520 | 7/1985 | Lampenius | 210/498 |
| 4,744,894 | 5/1988 | Gauld | 209/273 X |
| 4,855,038 | 8/1989 | LeBlanc | 209/273 |
| 5,000,842 | 3/1991 | Ljokkoi | 209/273 |
| 5,110,456 | 5/1992 | LeBlanc | 209/273 |
| 5,147,543 | 9/1992 | Frejborg | 210/413 |
| 5,192,438 | 3/1993 | Frejborg | 209/273 X |
| 5,307,939 | 5/1994 | Young et al. | 209/273 X |
| 5,476,178 | 12/1995 | Lamart | 209/300 X |

FOREIGN PATENT DOCUMENTS

| | | |
|---|---|---|
| 1156609 | 11/1983 | Canada . |
| 206975 | 12/1986 | European Pat. Off. . |
| 275921 | 7/1988 | European Pat. Off. . |
| 2264595 | 11/1975 | France . |
| 2526657 | 12/1976 | Germany . |
| 129814 | 2/1978 | Germany . |
| 3427390 | 2/1986 | Germany . |
| 2051600 | 1/1981 | United Kingdom . |
| 9400634 | 6/1994 | WIPO . |

*Primary Examiner*—William E. Terrell
*Assistant Examiner*—Tuan Nguyen
*Attorney, Agent, or Firm*—Leydig, Voit & Mayer, Ltd.

[57] ABSTRACT

Pressure sorter for the preparation of fiber suspensions obtained from waste paper, with a screen surrounding a rotor, a supply chamber between rotor circumference and screen as well an accepts chamber outside the screen and with profiled elements provided at the circumferential surface of the rotor for generating positive and negative pressure pulses, whereby in order to achieve good sorting results as well as a long service life of the screen, a rotor peripheral surface sector is provided between two profiled elements following one another in circumferential direction of the rotor, in every axial section of the circumferential surface of the rotor acting on the screen, this rotor peripheral surface sector being part of a peripheral surface area parallel to the screen inlet side, wherein—measured in circumferential direction of the rotor—the length of each profiled element is at least approximately equal to the length of the following rotor peripheral surface sector, the length of the latter, however, being at least approximately 30% of the length of the profiled element lying in front of it and wherein the profiled elements are designed such and are arranged at the rotor circumference such that—as seen in the direction of the screen axis—the rotor peripheral surface sectors form through-channels between the profiled elements along the region of the rotor surrounded by the screen.

28 Claims, 5 Drawing Sheets

PRESSURE SORTER FOR FIBER SUSPENSIONS

TECHNICAL FIELD

The invention relates to a pressure sorter for fiber suspensions, in particular, for the preparation of fiber suspensions obtained from waste paper, with a housing in which a stationary screen is arranged rotationally symmetrical to a screen axis, this screen separating a supply chamber encircled by the screen from an accepts chamber lying outside the screen in the housing, as well as a rotor drivable about the screen axis by a motor, the circumferential surface of this rotor together with an inlet side of the screen limiting the supply chamber in radial direction, an inlet for the fiber suspension to be treated communicating with a first axial end of the supply chamber and a rejects outlet communicating with a second axial end of the supply chamber, wherein profiled elements are provided at the circumferential surface of the rotor for generating positive and negative pressure pulses in the fiber suspension.

BACKGROUND

In pressure sorters of this type, the fundamental problem is that when no suitable countermeasures are taken, the throughput of usable fiber suspension through the screen and into the accepts chamber is drastically reduced in that the screen openings or apertures are clogged on the inlet side of the screen by impurities contained in the fiber suspension to be prepared, but also by fiber conglomerations; additionally, during the operation of such pressure sorters, the fibers contained in the fiber suspension to be prepared are fundamentally inclined to form a fiber fleece on the screen inlet side by means of which a high throughput of usable fibers (long as well as short) desired per se through the screen openings into the accepts chamber is prevented and besides, at least in most cases, undesired fractioning of the fiber suspension is effected—this means a separation of the fiber content in the fiber suspension to be prepared into shorter and longer fibers, whereby such a fiber fleece prevents, in particular, longer fibers from passing through the screen and into the accepts chamber.

The most varied measures are found in the state of the art by means of which it was attempted to control all or a part of the precedingly stated problems, whereby in this connection it needs to be realized that in pressure sorters of the type described in the beginning, the screen openings are intended to be flushed back by means of the negative pressure pulses generated by the profiled elements, i.e. by generating underpressure phases in the supply chamber liquid is intended to be sucked back from the accepts chamber through the screen openings and into the supply chamber in order to flush out from the screen openings impurities and fiber conglomerations collected at the inlet side of the screen openings.

A first measure, which can be deduced from the state of the art, consists in the fact that the screen openings are designed such that they widen in the conveying direction (i.e. in the direction from the supply chamber to the accepts chamber) (see for example, U.S. Pat. No. 3,581,903), in order to decrease the danger of the screen openings clogging up.

In order to effect a backwashing of the screen openings as well as to prevent a fiber fleece resulting on the inlet side of the screen, another known pressure sorter (see for example, U.S. Pat. No. 4,276,159) was equipped with a rotor which has in the vicinity of the screen inlet side rotating cleaning vanes with airfoil-like profile in section vertical to the rotor axis for generating positive and negative pressure pulses as well as having its screen designed such that due to the widened screen openings on the inlet side, a "roughened" screen inlet side results in order to generate turbulences in the fiber suspension to be prepared at the inlet side of the screen and in its vicinity by means of the interaction of the rotating rotor vane with the fiber suspension located in the supply chamber and the inlet side of the screen profiled in this manner, these turbulences counteracting the formation of a fiber fleece on the screen inlet side.

Also the most varied suggestions for the construction of a rotor of a pressure sorter can be deduced from the state of the art, namely, especially with reference to the design of the profiled elements for generating positive and negative pressure pulses in the fiber suspension in the supply chamber and/in the accepts chamber of the pressure sorter. The previously described cleaning vanes, as can be deduced for example from U.S. Pat. No. 4,276,159, were customary for a long time, as well as strip-shaped profiled elements, which extend approximately parallel to the screen axis and which are attached to the peripheral wall of a circular cylindrical and hollow rotor body. Examples for such strip-shaped profiled elements, which are arranged at a considerable distance from each other in the circumferential direction of the rotor, can be deduced, e.g. from FIG. 3 of DE-PS 25 26 657 as well as FIG. 3 of U.S. Pat. No. 4,200,537; in this respect, the last-mentioned state of the art shows strip-shaped profiled elements with an approximately triangular cross section, which have a first flank lying in front in the direction of rotation and projecting in radial direction beyond the peripheral surface of the rotor body, i.e. extending approximately perpendicular to the peripheral surface of the rotor body and a second flank sloping down towards the back. The fiber suspension located in the supply chamber of the pressure sorter is accelerated in rotational direction by the vertical front flank and it generates, in addition, positive pressure pulses while negative pressure pulses are generated by the sloping second flank.

Further rotor forms result, for example, from DD-PS 129 814 as well as from the U.S. Pat. Nos. 3,912,622, 3,726,401 and 3,400,820, however, these known rotor forms are not of importance in relation to the invention to be discussed in the following.

Other known suggestions concern the problem that due to the cleaning vanes or strip-shaped profiled elements which are continuous along the screen in the direction of the screen axis, such pressure impulses are generated in the fiber suspension that these impulses are disturbingly noticeable in the breast box of a paper machine following the pressure sorter (thereby, an uneven fiber fleece can form on the wire web of a paper machine). The fundamental idea of the known solutions to this problem is to subdivide the profiled elements into several segments transversely to the screen axis and to attach these segments to the peripheral surface of a circular cylindrical rotor body in such an arrangement that the segments following one another in the direction of the screen or rotor axis are offset relative to each other in circumferential direction of the rotor. In this respect, the profiled element segments of an axial rotor section each form a row in circumferential direction of the rotor, whereby a gap is located between two respective segments following one another in circumferential direction of the rotor and the lengths of the profiled element segments and the gaps—measured in circumferential direction of the rotor—are dimensioned such and the mentioned offset was chosen such that—as seen in the direction of the screen or rotor axis—the profiled element segments of an axial rotor section cover the gaps between the profiled element segments of the adjacent axial rotor sections. An example of such a rotor design can be deduced from DE-PS 37 01 669 (see in particular, FIG. 3); in this known rotor, the front surfaces or first flanks of the profiled element segments lying in front in rotational direction are designed such that they have a concave, arcuate profile in section vertical to the rotor axis, this profile ascending at an angle or diagonally towards the back and in radial direction towards the outside from the peripheral surface of the circular cylindrical rotor body in the direction opposite to the direction of rotation in order to reduce the impact effects of the pressure pulsations generated by the profile[1] element segments (see column 1, lines 12–14 of DE-PS 37 01 669).

Ultimately, a pressure sorter of the type mentioned in the beginning is disclosed in U.S. Pat. No. 4,855,038 and EP-0 206 975-B corresponding with the latter, the rotor of which is designed as a drum-shaped hollow body, whereby the peripheral wall of the rotor body forms two profiled elements directly adjoining each other in circumferential direction of the rotor, each element having a vertical leading first flank lying in a plane of diameter of the rotor as well as a second flank adjoined to the first and sloped downwards in the direction opposite to the direction of rotation. Each of these profiled elements extends over the entire length of the rotor in the direction of the rotor or screen axis, so that this also applies to the leading first flanks of the profiled elements extending parallel to the rotor axis. In addition, this known pressure sorter has a circular cylindrical screen, its inlet side (also when leaving the screen openings out of consideration) not being smooth but on the contrary, being profiled. Significance and purpose of the design of the rotor and the inlet side of the screen of this known pressure sorter is to constantly expose each region of the screen either to a positive or a negative pressure impulse, to generate great turbulences in the fiber suspension located in the supply chamber of the pressure sorter on account of the vertical leading flanks of the profiled elements and the great acceleration of the fiber suspension effected thereby in the direction of rotation in connection with the profiled inlet side of the screen and finally, to suck back considerable quantities of liquid from the accepts chamber through the screen and into the supply chamber of the pressure sorter by means of the long sloping second flanks of the profiled elements in order to eliminate with certainty the formation of a fiber fleece on the inlet side of the screen by a combination of all these measures.

SUMMARY OF THE INVENTION

The invention was based on the object of creating a pressure sorter of the type mentioned in the beginning which makes it possible to obtain a good sorting result with relatively fine screen openings in all consistency ranges of fiber suspensions to be prepared resulting in practice and particularly in this respect, to ensure a continuous operation free of interruptions.

Proceeding from a pressure sorter of the type mentioned in the beginning, with profiled elements which extend in circumferential direction of the rotor and each have a first flank lying in front in rotational direction for driving or urging the fiber suspension in rotational direction as well as a second flank lying behind the first flank in a direction opposite to the direction of rotation for sucking back liquid from the accepts chamber through the screen and into the supply chamber, this object can be accomplished in accordance with the invention in that in every axial section of the circumferential surface of the rotor acting on the screen, a rotor peripheral surface sector is provided between two profiled elements following one another in circumferential direction of the rotor, these profiled elements protruding in radial direction beyond this rotor peripheral surface sector and this sector being part of a peripheral surface area parallel to the screen inlet side as well as rotationally symmetrical to the screen axis, wherein—measured in circumferential direction of the rotor—the maximum length of each profiled element is at least approximately equal to the minimum length of the rotor peripheral surface sector following in the direction opposite to the direction of rotation, whereas the minimum length of each rotor peripheral surface sector is at least approximately 30% of the maximum length of the profiled element lying in front thereof in the direction of rotation, and wherein the profiled elements are designed such and are arranged at the rotor circumference such that—as seen in the direction of the screen axis—the rotor peripheral surface sectors form through-channels between the profiled elements along the region of the rotor surrounded by the screen.

With a pressure sorter according to the invention, optimal sorting results can be achieved, also especially with fiber suspensions to be prepared which have a higher consistency, namely with a material density of approximately 4% and more. This can be attributed to the fact that on the one hand, comparitively long profiled elements (measured in circumferential direction of the rotor) are used, their front first flanks generating relatively strong positive pressure pulses and greatly accelerating the fiber suspension in rotational direction and their long, sloping second flanks sucking larger quantities of liquid from the accepts chamber through the screen and into the supply chamber, effects which counteract the formation of a fiber fleece on the inlet side of the screen, that on the other hand however, gaps are provided between the profiled elements in the direction of rotation which—in rotational direction—are dimensioned to be of just such a length that a thin fiber fleece can form at the inlet side of the screen between the pressure pulsations generated by the profiled elements, this fleece acting as an auxiliary filter layer. The present invention thus teaches just the opposite to that which is the fundamental idea of the pressure sorter according to U.S. Pat. No. 4,855,038. On the other hand, in a pressure sorter according to the invention, a thick fiber fleece formation cannot result on the inlet side of the screen, so that with such a pressure sorter, those disadvantages which result in a thicker formation of fiber fleece on the inlet side of the screen can be avoided. In detail, the following is to be noted with respect to the advantages which can be achieved and the disadvantages which can be avoided in a pressure sorter according to the invention:

Fiber suspensions recovered from waste paper which need to be prepared normally contain adhesive particles which are either originally plastically deformable or become plastically deformable at the customary operating temperatures of pressure sorters. The strong positive pressure pulses which are generated in a pressure sorter of the type described in U.S. Pat. No. 4,855,038, however, lead to the fact that a considerable portion of such adhesive particles are also pressed through even small screen openings in absense of any fiber fleece on the inlet side of the screen. A pressure sorter according to the invention avoids this disadvantage by the production of a thinly formed fiber fleece due to the gaps between the profiled elements.

A thickly formed fiber fleece on the inlet side of the screen leads to a high fractioning of the fiber proportion of a fiber suspension—long fibers, which are desired per se in the accepted material, predominantly pass into the rejected material so that the relatively short fibers prevail in an undesired manner in the accepted material. Without any fiber fleece on the inlet side of the screen, however, long-fibered impurities, as for example hair, also pass into the accepted material in an undesired manner. At this point, the pressure sorter according to the invention leads to optimizing the sorting effect, because a lightly formed fiber fleece at the inlet side of the screen still allows long, useable fibers to pass into the accepted material to a considerable extent, while experiments have shown that such a fiber fleece prevents long-fibered impurities from passing through the screen. In a pressure sorter according to the invention, the frequently undesired high fractioning of the fibers can thus be avoided.

In a pressure sorter according to the invention, the so-called rejected material (the portion of the fiber suspension to be prepared which is held back by the screen) is not thickened to the extent that the sorting function of the device is permanently hampered in the region of the annular clearance between rotor and screen adjacent to the second axial end of the supply chamber. This can be ascribed, on the one hand, to the fact that the profiled elements have relatively long sloping second flanks and therefore suck back considerable quantities of liquid from the accepts chamber through the screen and into the supply chamber, by means of which the rejected material is diluted and that on the other hand, the channels present between the profiled elements passing through from one axial end of the supply chamber or the rotor to the other, lead to a widening in their region of the clearance between screen and rotor circumference, so that a comparatively thin fiber suspension can flow relatively without interference from the end of the supply chamber on the inlet side and along these widened clearance regions into those zones of the supply chamber in which the fiber suspension to be prepared is already thickened to a greater extent due to dewatering through the screen. In this connection, it is to be noted that in a pressure sorter, the fiber suspension in the supply chamber has a flow component directed parallel to the screen or rotor axis already due to the pressure with which the fiber suspension to be prepared is fed into the device. The widened clearance regions produced by the mentioned gaps, however, also lead to the fact that this axial flow component—in comparison with conventional sorters, as shown in U.S. Pat. No. 4,855,038 and DE-PS 37 01 669,—is reduced (an overall enlarged cross section of flow particularly, however, in front of the front first flanks of the profiled elements, is available in the annular clearance between rotor circumference and screen), which results in a decrease in the energy to be used for driving the rotor, because the steep front first flanks of the profiled elements do not need to "cut through" such a strong longitudinal flow.

Despite the formation of a light fiber fleece on the inlet side of the screen of the pressure sorter according to the invention, higher throughput capacities, however, can be achieved herewith than with a pressure sorter according to U.S. Pat. No. 4,855,038 (screen openings of equal size being presupposed), because the sloping second flanks of the profiled elements of the pressure sorter according to the invention which are shorter in comparison with the profiled elements of this known pressure sorter, have shorter underpressure or suction phases as a result, during which the flow desired per se through the screen from the supply chamber into the accepts chamber cannot take place. From this, it is also apparent that with the profiled elements of the known pressure sorter according to U.S. Pat. No. 4,855,038—same throughput capacity being presupposed—greater positive pressure impulses need to be generated which, in the absense of a fiber fleece serving as auxiliary filter layer, leads to a high percentage of the previously mentioned adhesive particles being pressed through the screen openings and into the accepts chamber. The same applies to the long-fibered impurities contained in the fiber suspension to be prepared due to the strong positive pressure pulses and the high rate of flow through the screen openings effected thereby.

As already mentioned, the leading front surfaces or first flanks of the profiled elements of the rotor of the known pressure sorter according to U.S. Pat. No. 4,855,038 extend exactly parallel to the screen or rotor axis. In an advantageous embodiment of the pressure sorter according to the invention, the longitudinal direction of the first flank of each profiled element, however, forms an acute angle with the axial direction. Thereby, the service life of the screen is prolonged considerably; it has been proven that in the described known pressure sorter, the screen is at a considerable risk of breakage, namely due to several reasons which will be explained in detail later on, however, particularly due to the following reason: as mentioned, profiled elements forming a step at the front generate strong positive pressure pulses and with that, pressure forces acting on the screen which are introduced to the screen in the known pressure sorter along a peripheral surface line (a line parallel to the screen axis) due to the axial course of the front edges of the profiled elements. Since it is endeavoured to construct the screen of a pressure sorter as thin-walled as possible for preventing even higher pump capacities for supplying a pressure sorter due to the flow resistance of the screen openings and the decrease in pressure connected therewith across the screen, the screen of the pressure sorter according to U.S. Pat. No. 4,855,038 is at a high risk of breakage. When the first flanks of the profiled elements lying in front in the direction of rotation are slightly inclined with respect to the direction of the screen axis, as in the described preferred embodiment of the pressure sorter according to the invention, the introduction of the pressure forces, which bring about the positive pressure pulses generated by these first flanks, does not result along a peripheral surface line of the screen, and experiments have confirmed that endurance failures at the screen can be prevented thereby.

In order to achieve the illustrated advantage, the first flanks of the profiled elements could be inclined in every direction with respect to the screen axis. For example, it would be conceivable to select the inclination such that the first flanks of the profiled elements exert on the fiber suspension present in the supply chamber an axial conveying effect in the direction from the second axial end of the supply chamber to its first axial end in order to—as is known per se in pressure sorters—convey the already thickened fiber suspension to be prepared located in the rear portion of the supply chamber back again in axial direction and thereby to see to it that the consistency of the fiber suspension to be sorted is homogenized and that the usable fibers are separated even more extensively into the accepts chamber. However, embodiments of the pressure sorter according to the invention are preferred in which the longitudinal direction of the first flank of each profiled element is inclined with respect to the axial direction such that the first flanks exert on the fiber suspension present in the supply chamber an axial conveying effect towards the second axial end of the supply chamber. It has been proven that the sorting result can be improved even further thereby: by means of such a conveying effect, the not yet thickened fiber suspension is conveyed to an even greater extent from the inlet side end of the supply chamber into its rear region (the region facing the second axial end of the supply chamber) and thereby the consistency of the fiber suspension to be sorted is homogenized along (in axial direction) the rotor or the screen.

Especially for embodiments of the pressure sorter according to the invention in which the first flanks of the profiled elements are inclined in relation to the axial direction, it is recommended that the profiled elements be designed and arranged such that the rear edge of the second flank extends parallel to the screen axis in order to prevent a narrowing of the interior cross section of the previously mentioned channels or the widened annular clearance regions.

By means of the first flanks of the profiled elements lying front, positive pressure pulses are intended to be generated and the fiber suspension driven in the direction of rotation. Both can be achieved best in that the profiled elements are designed such that their first flank protrudes approximately in radial direction beyond the rotor peripheral surface sector lying in front of this flank. The first flank could, however, also be slightly inclined in relation to the radial direction, namely sloping towards the interior (in the direction towards the rotor axis) and towards the rear (opposite to the direction of rotation), while first flanks inclined diagonally outwards and towards the back (as shown in DE-PS 37 01 669) can lead to the fact that the fiber suspension located in front of a profiled element is only pushed outwards in radial direction against the screen and is not or hardly accelerated in the direction of rotation.

In a pressure sorter according to the invention, every profiled element can extend in the direction of the rotor axis over the entire length of the rotor circumference surrounded by the screen; in this case, the rotor has only one (extending in circumferential direction of the rotor) row of profiled elements and gaps arranged therebetween. However, especially for sorting fiber suspensions with higher material density, inventive pressure sorters with another rotor design are recommended: such pressure sorters distinguish themselves in the fact that the rotor has as least one first axial rotor circumferential surface section facing the first axial end of the supply chamber as well as at least one second axial rotor circumferential surface section adjacent to this first section in axial direction, wherein the first flanks of the profiled elements of the second section are offset backwardly with respect to the first flanks of the profiled elements of the first section in a direction opposite to the direction of rotation and the lengths of the profiled elements measured in circumferential direction of the rotor are dimensioned such that rotor peripheral surface sectors (gaps) of the two axial rotor sections adjacent to each other in axial direction overlap each other in the direction of rotation. The rotor of such an inventive pressure sorter thus has, in particular, two axial sections and with that, two (extending in rotor circumferential direction) rows of profiled elements and gaps arranged therebetween, whereby the profiled elements of the one row and with that the gaps of this row in relation to those of the other row are offset in relation to each other only so far in circumferential direction of the rotor that the gaps of both rows form channels, as before, which extend in axial direction over both rows or both rotor sections. By means of such a rotor design, the following additional advantages are achieved: in profiled elements of which the front first flanks extend from the one to the other axial end of the rotor or screen, there is, in particular when these first flanks extend parallel to the rotor axis—as in the state of the art—the danger that the impurities as well as fibers contained in the fiber suspension to be sorted, will collect and conglomerate at these steep first flanks which particularly involves the danger that such material accumulations wedge themselves between the radially outer edge of the first flanks and the screen and thus make the pressure sorter inoperable or even lead to screen breakage. A staggered arrangement of the profiled elements as described previously now results in the following effects, especially when the front or leading first flanks are inclined in relation to the axial direction such that they exert a conveying effect in the direction towards the second axial end of the supply chamber: already the axial flow alone, which is effected by the conveying pressure in the inlet of the pressure sorter, through the annular clearance between rotor circumference and screen (of the supply chamber) leads to the fact that material accumulations at the first flanks of the profiled elements of the first axial rotor section glide along these first flanks in the direction towards the second axial end of the supply chamber; should these material accumulations reach the edges of the profiled elements of the first rotor section facing the second axial end of the supply chamber, then they are mixed there with the fiber suspension due to the turbulences occurring there, so that the material accumulations are broken up at least essentially before the fiber suspension is engaged by the next first flank of a profiled element of the second axial rotor section. This axial drainage of undesired material accumulations is, in addition, increased further when the first flanks of the profiled elements are inclined in the described manner. By means of the previously described staggered arrangement of the profiled elements, the fiber suspension to be sorted is, in addition, sufficiently fluidized also in those regions of the annular space between rotor circumference and screen in which the consistency of the fiber suspension to be sorted has already increased as a result of the preceding dewatering through the screen, so that a good sorting effect can also be achieved in these regions. Furthermore, the previously described staggered arrangement of the profiled elements effects an even better distribution of the pressure forces across the screen, i.e. those pressure forces which are generated by the positive pressure impulses caused by the profiled elements and act on the screen.

In order to maintain the effect of the precedingly described channels or the widened regions of the annular clearance between rotor circumference and screen to a sufficient extent in such a staggered arrangement of the profiled elements but on the other hand, to also see to it that the fiber suspension is adequately fluidized over the entire axial length of the screen or rotor by means of a sufficient offset (in rotational direction) of the front first flanks of profiled elements adjacent to each other in axial direction, the overlapping of rotor peripheral surface sectors (gaps) adjacent to each other in axial direction—measured in circumferential direction of the rotor—is at least approximately 50% of the length of one of the rotor peripheral surface sectors in a particularly advantageous embodiment of the inventive pressure sorter with profiled elements in a staggered arrangement.

Fundamentally, the profiled elements of different axial rotor sections could be designed so as to be identical. However, it is recommended to take the different consistency of the fiber suspension to be sorted in the various axial regions of the annular space between rotor circumference and screen into account by using a correspondingly different design of the profiled elements, so as not to generate either unnecessarily strong positive and negative pressure impulses in certain axial regions of this annular space or to generate too weak positive and negative pressure impulses in other axial regions of this annular space. Therefore, it is recommended in a preferred embodiment of an inventive pressure sorter with profiled elements staggered in the manner described previously, to dimension—measured in circumferential direction of the rotor—the profiled elements in the first axial rotor circumferential surface section so as to be shorter than in the second rotor circumferential surface section. As an alternative or in addition to this measure, the height of the first flanks of the profiled elements—measured in radial direction—can, for the same purpose, be dimensioned so as to be smaller in the first axial rotor circumferential surface section than in the second rotor circumferential surface section.

As already mentioned, it is recommended to design the first flank of the profiled elements such that the fiber suspension can be effectively accelerated therewith in rotational direction. First flanks of the profiled elements designed in such a manner are particularly advantageous since the fiber suspension can be accelerated therewith in rotational direction up to the circumferential speed of the rotor, because then maximum positive pressure impulses and particularly strong turbulences are generated by the profiled elements.

The effectiveness, the throughput capacity and the sorting behaviour of a pressure sorter depend to a considerable extent on the smallest radial distance of the profiled elements from the screen, the construction and arrangement of the profiled elements and also very essentially on the rotational speed of the profiled elements. In a pressure sorter according to the invention, an increase of the rotational speed of the rotor does not only lead to stronger turbulences, but also to a lighter formation of the fiber fleece desired per se to a certain extent on the inlet side of the screen. The less such a fiber fleece forms, the less a frequently undesired fractioning of the fiber suspension or the fibers contained therein, results; besides, a thinner fiber fleece formation leads to a higher consistency in the accepted material, a lower consistency of the rejected material and finally to a decrease of the sorting purity. Naturally, an increase of the rotational speed of the rotor finally leads to an increase of the wear and tear on rotor and screen (fiber suspensions obtained from waste paper always contain abrasive impurities, like sand and metal parts). On the other hand, the sorting of fiber suspensions with higher consistency or material density requires a higher rotational speed of the rotor than when sorting thinner fiber suspensions. Certain disadvantages of a higher rotational speed of the rotor can now be avoided in a pressure sorter according to the invention by the use of shorter (measured in circumferential direction of the rotor) and/or lower (measured in radial direction) profiled elements. For the sake of completeness, it is also to be noted that higher rotational speeds of the profiled elements allow the use of screens with finer screen openings (bores of smaller diameter or narrower slots), whereby the sorting purity is improved.

Pressure sorters which have been made known up till now, have a rotor drive which only allows operation with a very specific rotational speed of the rotor. From the previous explanations, it is apparent, however, that it would be desirable per se to be able to operate one and the .same pressure sorter with different rotational speeds of the rotor in order to be able to take the consistency or material density, for example, of the fiber suspension to be sorted into consideration or to be able to achieve certain sorting results. This is remedied by the invention in suggesting that a three-phase A.C. motor be used as motor for driving the rotor, this motor being supplied by a frequency converter controllable with respect to its output frequency. In such a pressure sorter, the rotational speed of the rotor can be varied solely by changing the setting of the frequency converter and with that the frequency of the supply current for the three-phase A.C. motor and, thus, this rotational speed can be adapted to the respectively desired sorting process or sorting result.

Since the thickness of the fiber fleece formation on the inlet side of the screen depends considerably on the rotational speed of the rotor in a specific inventive pressure sorter, and the thickness of the fiber fleece formation, on the other hand, influences the magnitude of the pressure difference which prevails between the inlet side of the screen and the other screen side, i.e. between supply chamber and accepts chamber, this pressure difference can be used according to the invention as standard parameter for the frequency converter; in a preferred embodiment of the pressure sorter according to the invention, the frequency converter is thus controllable by means of a measuring device for measuring the pressure difference between supply chamber and accepts chamber. In this manner, the thickness of the fiber fleece formation on the inlet side of the screen can be predetermined and with that the sorting result by specifying a desired pressure difference.

Especially with a view to rationally manufacturing a pressure sorter according to the invention as well as the fact that wear and tear of the profiled elements, especially in the region of their front first flanks, cannot be avoided, the invention suggests several particularly advantageous embodiments of the rotor of inventive pressure sorters.

In an embodiment which can be manufactured without particularly complicated tools, the rotor has a circular cylindrical and hollow rotor body, the peripheral surface of which forms the rotor peripheral surface sectors and in which the first flanks of the profiled elements are formed by strips attached to the peripheral surface of the rotor body and the second flanks of the profiled elements by metal sheets arcuately curved in the side view, the front edges of which are attached to the strips and their back edges to the peripheral surface of the rotor body. The strips and metal sheets could be attached to the rotor body or to the strips, for example, by screws; however, embodiments are preferred in which the strips are welded onto the rotor body and/or in which the metal sheets are welded onto the strips and the rotor body. With profiled elements resulting in this manner, suitable care is taken that the cavities are sealed so as to be impervious to liquid in order to prevent the occurance of imbalances. This problem can also be eliminated in that the cavities formed by the peripheral wall of the rotor body and the profiled elements are filled with a plastic which, for example, can be a hardenable casting resin; however, it is more advantageous when a foamed plastic foamed in-situ is used, since these cavities can be filled completely and without problems such that liquid cannot penetrate these cavities.

With profiled elements designed in this manner, the strips can be exchanged relatively easily, which is particularly important because especially the strips forming the front first flanks of the profiled elements are subject to the greatest wear and tear.

As an alternative, it is suggested to design the profiled elements according to the invention as solid plastic bodies which can be economically manufactured as plastic injection moulded parts. Such solid plastic bodied profiled elements could be exchanged as a whole in the case of wear and tear; however, this is not necessary when the front surface of the profiled elements lying in front in the direction of rotation is formed by a metal strip which, for example, is inserted into the solid plastic body, since then in the case of wear and tear, only this metal strip needs normally to be replaced.

If sufficient turbulences cannot be generated for certain sorting functions with the aid of a rotor constructed in accordance with the invention and a screen designed so as to be smooth on the inlet side in order to prevent the formation of a too thick fiber fleece on the inlet side of the screen, an embodiment of the inventive pressure sorter ought to be used in which the inlet side of the screen has a turbulence-generating profile. Such profiles can be deduced from the state of the art.

BRIEF DESCRIPTION OF THE DRAWING

Further features, advantages and details of the invention result from the attached claims and/or from the following description of a particularly advantageous embodiment of the pressure sorter according to the invention on the basis of the accompanying drawings; in the drawings:

DETAILED DESCRIPTION OF THE PREFERRED EMBODIMENT

Figure 1:
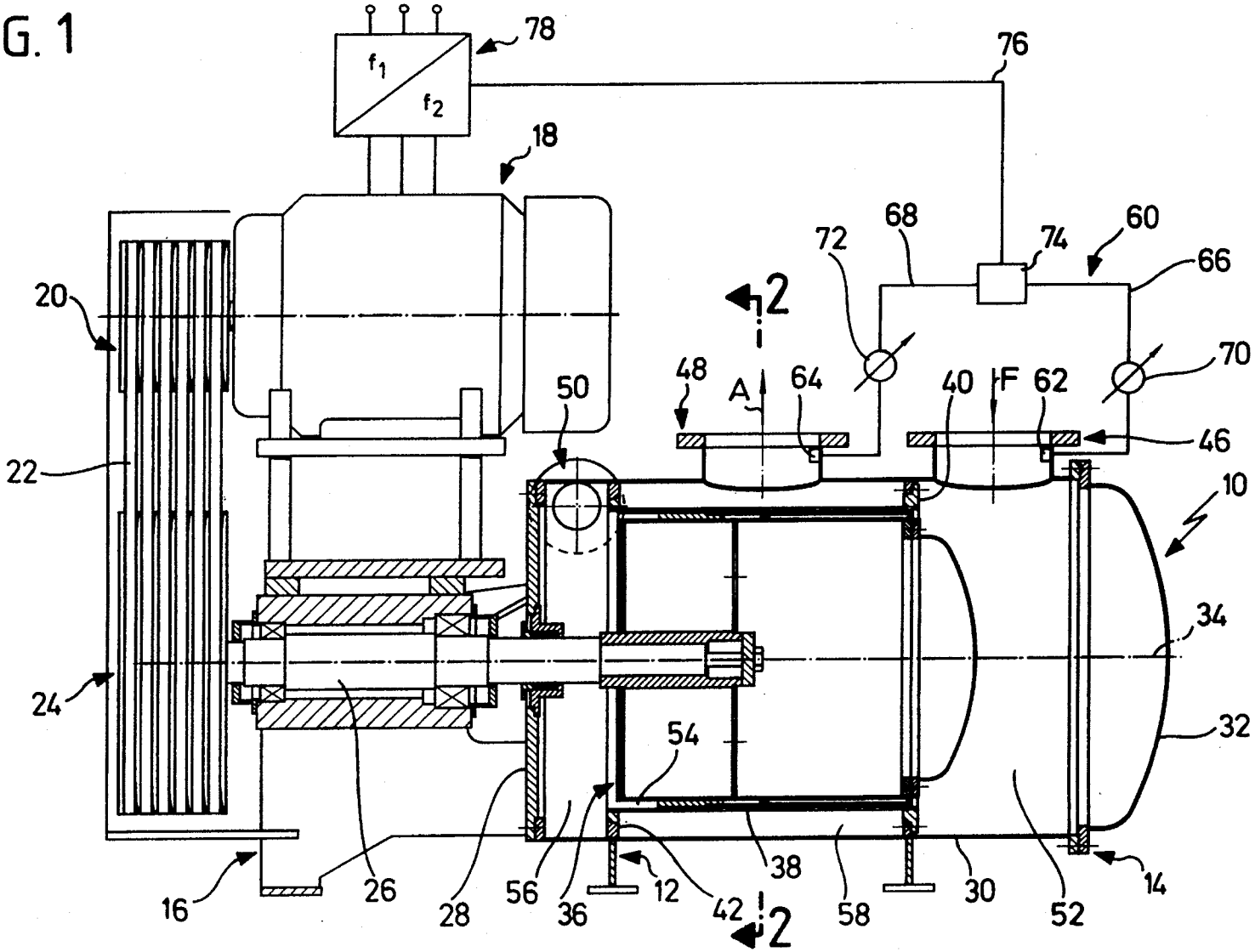
FIG. 1 is a partially sectional side view of the inventive pressure sorter, whereby the sectional illustration is a section in a vertical plane of diameter of the rotor or screen.

A motor 18 standing on a frame 16 also belongs to the actual pressure sorter 10 represented in FIG. 1 with a housing 14 resting on supports 12, this motor being a rotary current or three-phase A.C. motor which drives a belt pulley 24 by means of a belt pulley 20 and a V-belt 22, this belt pulley 24 being fixed to a rotor shaft 26 rotatably mounted in the frame 16 as well as in the housing 14.

The housing 14 essentially consists of a front wall 28 to the left according to FIG. 1, a circular cylindrical housing shell 30 arranged concentrically to the rotor shaft 26 as well as a housing lid 32 which are connected with each other so as to be pressure-tight. An axis of the pressure sorter which is also the axis of the rotor shaft 26 has been designated with 34.

The rotor shaft 26 guided through the front wall 28 in a pressure-sealed manner bears a rotor designated as a whole with 36 which is drivable about the axis 34 with the aid of the rotor shaft 26 and is surrounded by a circular cylindrical screen 38 which is concentric to the axis 34, is attached to two annular-shaped housing elements 40 and 42 fixed to the housing shell 30 and is held by these housing rings in this manner.

In the represented embodiment, the axial length (in the direction of the axis 34) of the rotor 36 equals the axial length of the operative region of the screen 38 between the housing rings 40 and 42. It would also be possible to select the axial length of the rotor 36 so as to be greater or smaller than the axial length of the screen 38 in order to achieve specific effects.

At the right end of the housing 14 according to FIG. 1, an inlet connecting piece 46 is provided through which—as indicated by the arrow F—the fiber suspension to be prepared or to be sorted is conveyed into the pressure sorter, namely by means of a pump not represented. Approximately in the middle, above the screen 38, an outlet connecting piece 48 is fitted to the housing shell 30 through which the so-called accepted material—as indicated by the arrow A—exits the pressure sorter. The accepted material is that part of the fiber suspension which has passed through the screen 38. Finally, at the left end of the housing shell 30 according to FIG. 1, a second outlet connecting piece 50 is attached through which the so-called rejected material—as is indicated by the arrow R in FIG. 2—exits the pressure sorter; the rejected material is that part of the fiber suspension to be prepared which cannot pass through the screen 38.

Figure 2:
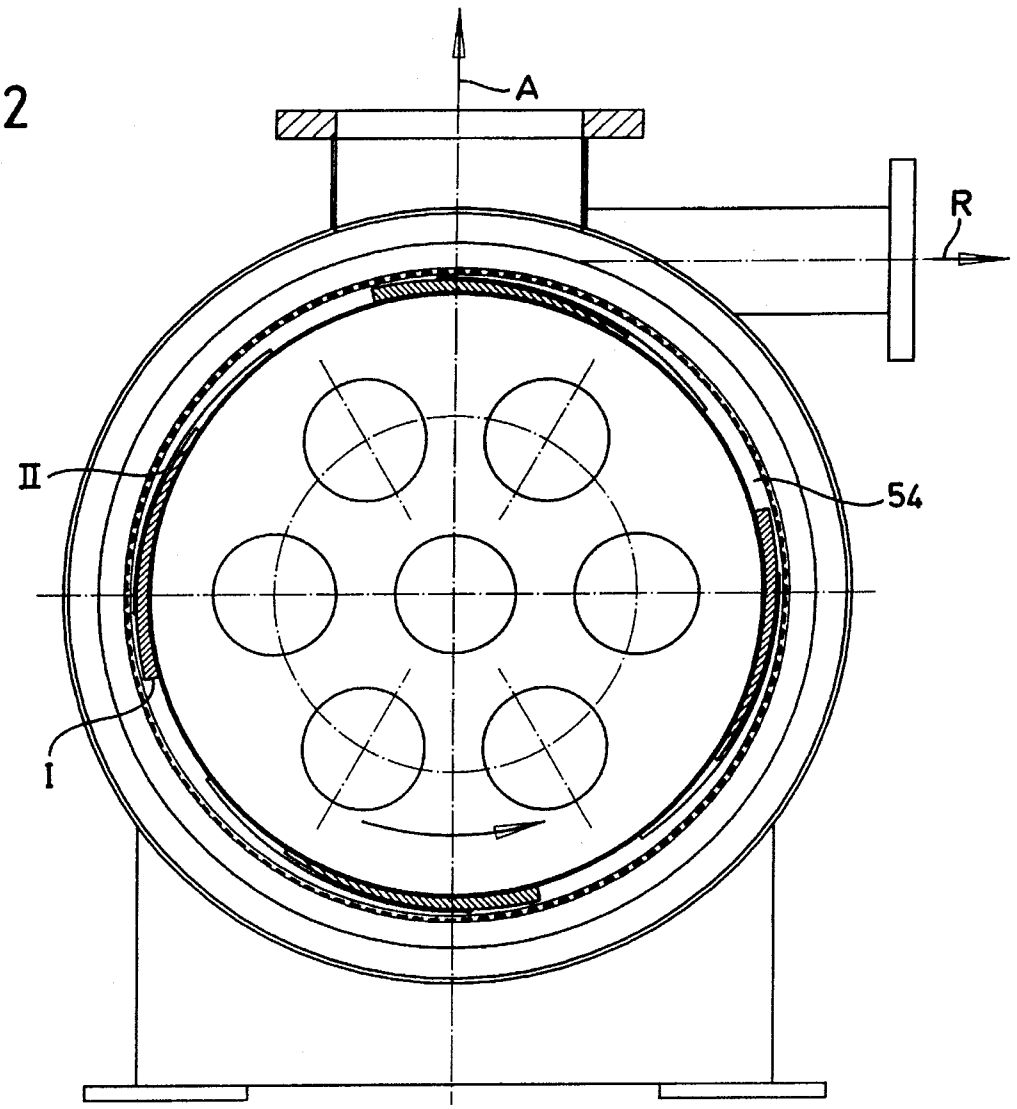
FIG. 2 is a section along the line 2—2 in FIG. 1.

Contrary to the representation in FIG. 1, the intake connecting piece 46 will be suitably arranged such that the fiber suspension to be sorted flows approximately tangentially into the housing 14 in the same way as the outlet connecting piece 50 is aligned tangentially for the rejected material (see FIG. 2). In addition, the outlet connecting piece 48 could, of course, also be arranged at the bottom of the housing shell 30, inasfar as the arrangement of the pressure sorter 10 allows for the drainage of accepted material downwards.

Inasfar as the construction of the pressure sorter is described previously, this is known from the state of the art and this also applies to its fundamental function inasfar as it is described as follows (inventive variations will only be mentioned subsequent to the description of the fundamental function).

The fiber suspension to be prepared which is fed into the pressure sorter 10 via an intake connecting piece 46 first of all reaches an intake chamber 52 and it then enters an annular chamber between the circumference of the rotor 36 and the screen 38 and which is designated in the following as supply chamber 54, and the fiber suspension to be sorted enters the latter via a first axial end **54*a* of this supply chamber. As a result of the rotor 36 rotating about the axis 34 as well as, if necessary, the tangential alignment of the intake connecting piece 46 and due to the pressure under which the fiber suspension to be sorted is conveyed into the pressure sorter 10, the fiber suspension streams in a helical line through the supply chamber 54 from its first end 54*a* to its second end 54*b*, whereby a portion of the fiber suspension passes through openings or apertures of the screen 38 and reaches the accepts chamber 58 in this manner. The rejected material leaves the supply chamber 54 at its second end 54*b* and in this manner reaches the rejects chamber 56 from which the rejected material leaves the pressure sorter via the second outlet connecting piece 50**.

In preferred embodiments of the pressure sorter according to the invention, the axis 34 extends at least approximately horizontally; fundamentally, it would also be conceivable, however, to assemble the pressure sorter such that its axis 34 extends at least approximately vertically.

In the following, the inventive features of the pressure sorter will be explained as well as the sorting procedure performed thereby.

Due to the relatively fine openings of the screen 38, a pressure difference results between supply chamber 54 and accepts chamber 58, in fact the pressure in the accepts chamber is lower than in the supply chamber. In order to determine this pressure difference, a measuring device 60 is provided according to the invention which comprises a first pressure transmitting means 62 and a second pressure transmitting means 64 which are arranged in the intake connecting piece 46 or the first outlet connecting piece 48, likewise however, they could also be arranged in the intake chamber 52 and in the accepts chamber 58, respectively. They are connected with the inputs of a difference creating device 74 via lines 66 and 68 in which indicating devices 70 and 72 are arranged, this difference creating device delivering at its output a control signal proportional to the pressure difference, this signal being applied to the control input of a frequency converter 78 via a line 76. This converter is supplied by a current source not illustrated with a three-phase alternating current or rotary current having the frequency $f_1$ and delivers a three-phase alternating current having the frequency $f_2$ for driving the three-phase A.C. current motor 18, whereby the frequency $f_2$ is a function of the control signal generated by the difference creating device 74. In this manner, the rotor 36 is driven with a rotational speed which is a function of this control signal and, therefore, is the pressure difference between supply chamber 54 and accepts chamber 58. Instead of the indicating devices 70 and 72 or in addition to these, potentiometers or other regulating elements could also be provided in the lines 66 and 68, the signals delivered by the pressure transmitting means 62 and 64 being changeable by these regulating elements in order to influence the dependency of the control signal applied to the line 76 on the mentioned pressure difference.

Figure 3:
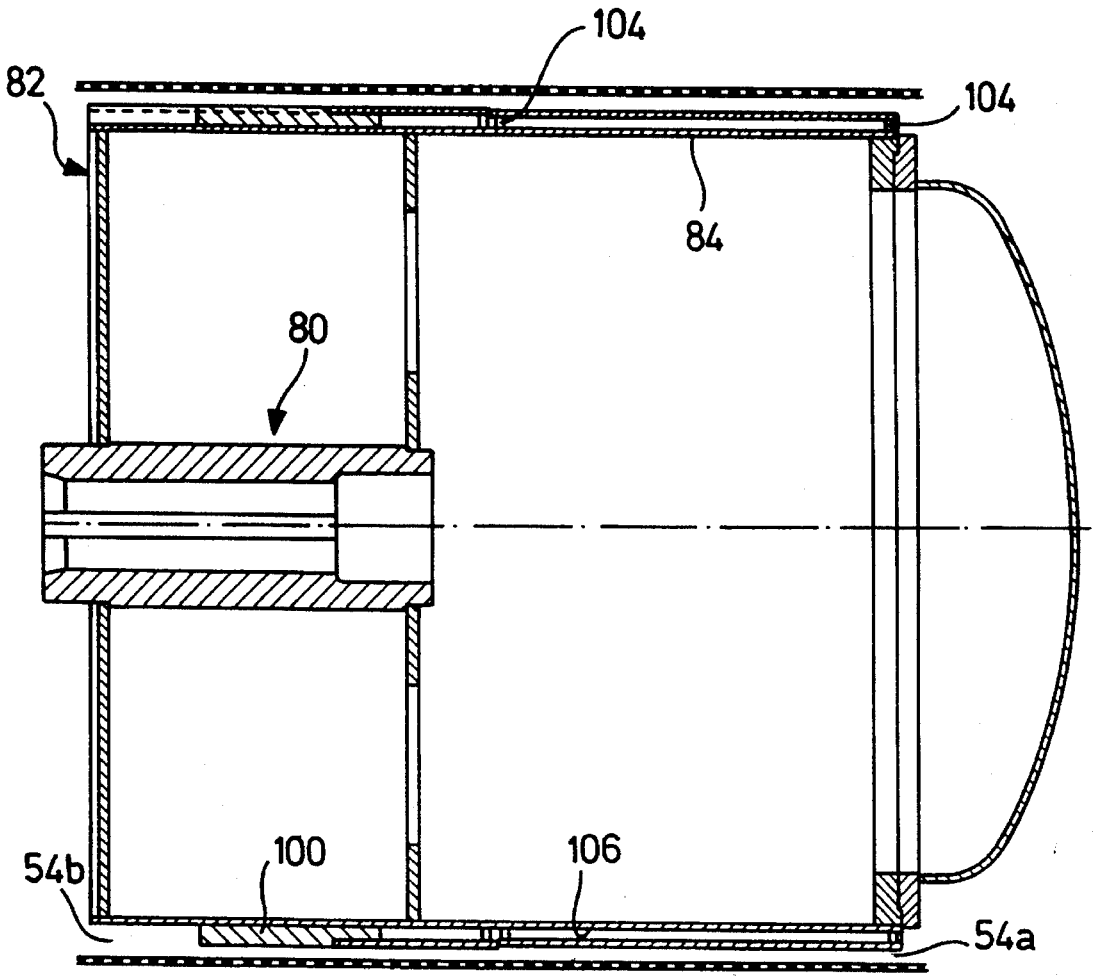
FIG. 3 is the screen and rotor of the pressure sorter as represented in FIG. 1, however on a larger scale than in FIG. 1.
Figure 4:
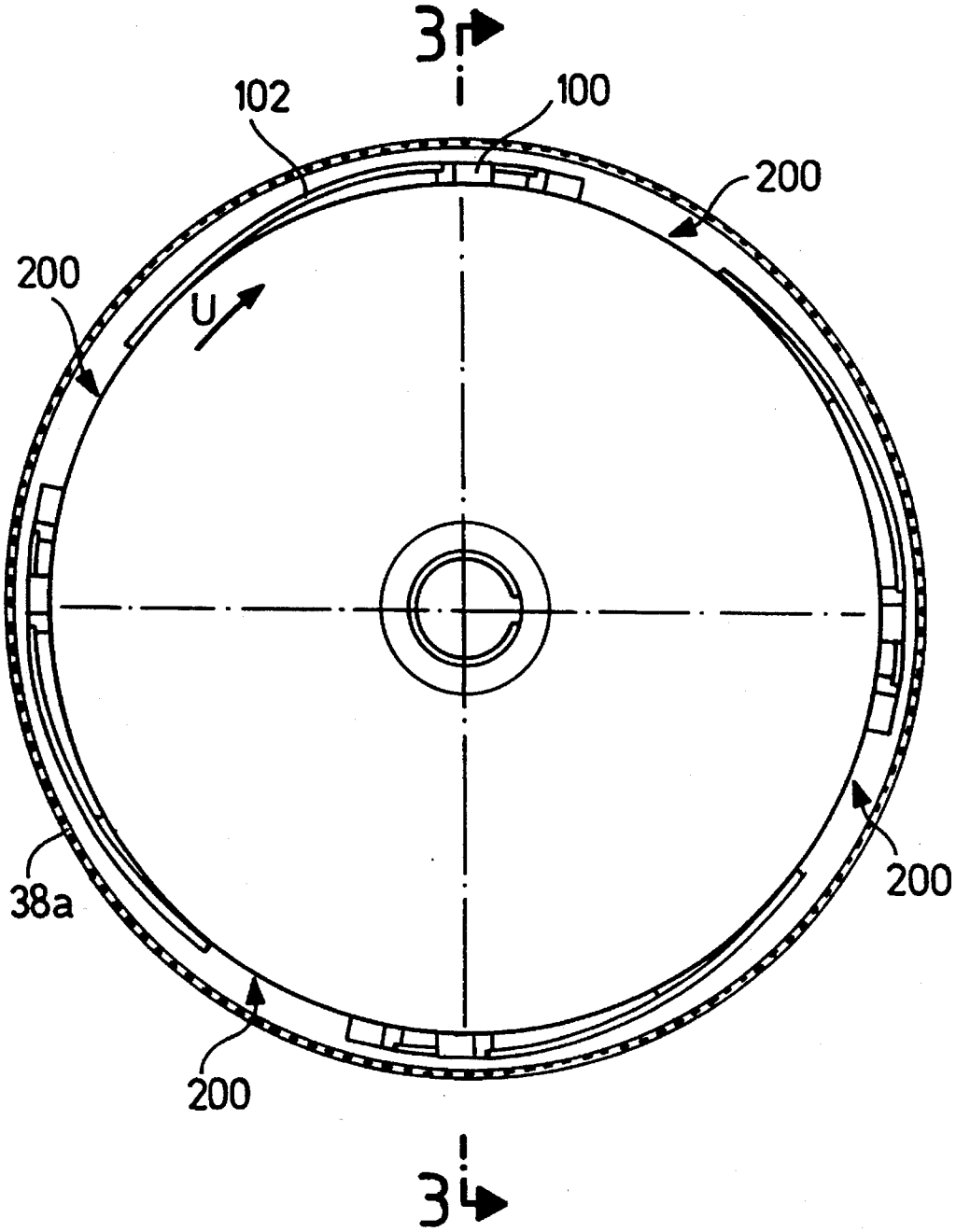
FIG. 4 is a front view of the rotor, seen from the left according to FIG. 1, namely including screen represented in an axial section.
Figure 5:
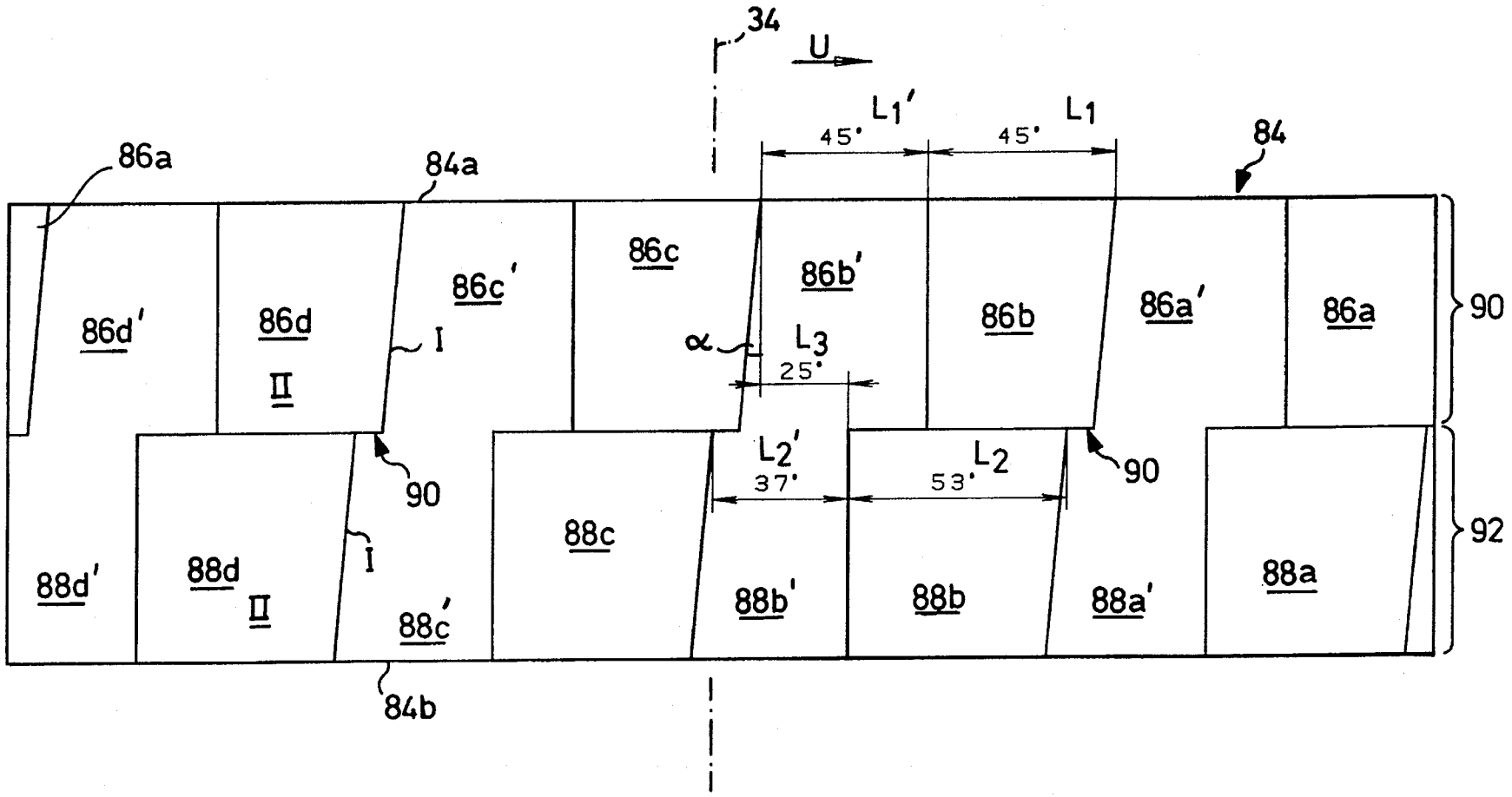
FIG. 5 is a layout of the rotor circumference, i.e. a plan view of the entire circumferential surface of the rotor which is, however, represented in one plane.

On the basis of FIGS. 3 to 5, the inventive design of the rotor 36 it now to be explained in detail.

A hub 80 fixedly connected with the rotor shaft 26 bears a closed, hollow circular cylindrical rotor body 82 with a circular cylindrical rotor shell 84. This has a first axial end 84*a* at the first axial end 54*a* of the supply chamber 54 and a second axial end 84*b* at the second axial end 54*b* of the supply chamber and bears two sets of profiled elements on the outside, namely a first set which is formed by profiled elements 86*a*, 86*b*, 86*c* and 86*d* as well as a second set formed by profiled elements 88*a*, 88*b*, 88*c* and 88*d*. The first set of profiled elements forms a first row of profiled elements extending in circumferential direction of the rotor or rotational direction U of the rotor with gaps 86*a*', 86*b*', 86*c*' and 86*d*' arranged between these elements, and this row defines a first axial rotor section 90 which faces the intake chamber 52; the second set of profiled elements 88*a*–88*d* forms a second, identical row of profiled elements and gaps 88*a*', 88*b*', 88*c*' and 88*d*' arranged therebetween, and this second row defines a second axial rotor section 92 which is adjacent to the rejects chamber 56. In the represented preferred embodiment, all profiled elements are of the same height (measured in the direction of the axis 34), depending on the desired sorting result and/or as a function of the type of fiber suspension to be sorted, it could be expedient, however, to select the height of the first row so as to be greater or smaller than the height of the second row. In addition, it could be expedient to provide the rotor with more than two such rows.

As is particularly the case in FIGS. 2 and 4, each profiled element has a front surface or first flank I lying in front in rotational direction U, which extends vertically to the circular cylindrical outer circumferential surface of the rotor shell 84 and, therefore, to the surface of the gap lying in front thereof in rotational direction U, as well as a rear surface or second flank II directly adjoining the first flank I, this second flank sloping inwardly in radial direction opposite to the rotational direction U and with that towards the axis 34, so that the profiled elements in section have a cross section vertical to the axis 34, this cross section resembling a very acute-angled triangle which has been bent concentrically to the axis 34. Strong positive pressure pulses and strong turbulences are generated in the supply chamber 54 by the first flanks I; in addition, the fiber suspension in the supply chamber 54 is greatly accelerated by the first flanks I, namely at the most up to the rotational speed of the profiled elements. On the other hand, the sloping second flanks II generate negative pressure impulses by means of which liquid is sucked back from the accepts chamber 58 through the screen openings and into the supply chamber 54. Particularly strong turbulences result in the supply chamber 54 due to the flow component of the fiber suspension directed in rotational direction U when the inner side of the screen 38 is designed in the known manner so as to be "rough", i.e. profiled; since such profiled screens are known in pressure sorters and since suitable profiles are difficult to illustrate in the attached drawings, this profiling cannot be deduced from the drawings.

According to the invention, the first flanks I do not extend parallel to the axis 34 in preferred embodiments of the pressure sorter according to the invention, but form an acute angle $\alpha$ with the direction of the axis 34, in fact the flanks I are inclined in relation to the direction of the axis 34 such that the flow component of the fiber suspension in the supply chamber 54 extending in the direction of the axis 34 is increased in the direction from the first axial end 54*a* of the supply chamber to its second axial end 54*b*.

As can be deduced from FIG. 5, the profiled elements 86*a*–86*d* of the first row in the represented preferred embodiment are shorter—measured in circumferential direction of the rotor or rotational direction U—than the profiled elements 88*a*–88*d* of the second row. This measure serves the purpose of adapting the effect of the profiled elements to the different consistency of the fiber suspension, the consistency of which increases in the supply chamber 54 from its first end 54*a* to its second end 54. In the particularly advantageous embodiment represented in FIG. 5, each of the profiled elements 86*a*–86*d* of the first row extends over a circumferential angle of 45° (this is the maximum length $L_1$ of the profiled elements), whereby the length of the profiled elements decreases towards the second axial end 84*b* of the rotor shell 84, because the first flanks I extend at an angle to the direction of the axis 34 while the rear edges of the second flanks II are aligned parallel to the axis 34. The smallest length $L_1$' of the gaps 86*a*'–86*d*' of the first row is also 45° and with that is equal to the greatest length $L_1$ of the profiled elements of this row, whereby the length of the gaps in the direction towards the second axial end 84*b* of the rotor shell 84 increases.

The maximum length $L_2$ of the profiled elements 88*a*–88*d* of the second row is 53° in this embodiment; since, according to the invention, the number of profiled elements of the second row equals the number of profiled elements of the first row, a lower value of 37° results here for the minimum length $L_2$' of the gaps 88*a*'–88*d*' of the second row.

As is similarly deducible from FIG. 5, the profiled elements 88*a*–88*d* of the second row and with that their gaps are offset in relation to the profiled elements of the first row or their gaps opposite to the rotational direction U, whereby the magnitude of the offset or displacement is adapted to the lengths of the profiled elements or the gaps such that gaps adjacent to each other in axial direction of both rows overlap each other to such an extent in rotational direction U or in circumferential direction of the rotor that they form a through-channel in axial direction, which extends from the one axial end 84*a* of the rotor shell 84 up to its other axial end 84*b*. In the embodiment represented in FIG. 5, the interior width $L_3$ of this channel is 25°, whereby the interior width is to be understood as that width which the viewer sees in a front view of the rotor in the direction of the axis 34.

In the represented preferred embodiment, the lengths of the profiled elements of the first row are approximately equal to the lengths of the gaps of the first row, the lengths of the profiled elements of the second row are greater than the lengths of the profiled elements of the first row, and the lengths of the gaps of the second row are smaller than the lengths of the profiled elements of the second row and smaller than the lengths of the gaps of the first row.

By means of the inventive arrangement of the profiled elements of the two rows, steps 90 result by means of which the following effect is achieved: accumulations of fibers and impurities which can occur at the first flanks I of the profiled elements 86*a*–86*d* of the first row, glide along the first flanks I of the profiled elements of the first row in the direction towards the second axial end 54*b* of the supply chamber 54 due to the axial flow component of the fiber suspension in the supply chamber 54 and thereby reach the steps 90, in the region of which they are broken up due to the strong turbulences prevailing there and are mixed with the fiber suspension—accumulations of fibers and impurities at the first flanks I of the profiled elements 88*a*–88*d* of the second row are also transported in axial direction and reach the rejects chamber 56.

Hereinabove, the lengths of the profiled elements and the gaps have been expressed in circumferential angles. In the practical realisation of the inventive pressure sorter, the lengths $L_1$ and $L_2$ lie within a range of between approximately 200 mm and approximately 450 mm.

The circumferential speeds of the rotor achieved by the adjustment of the rotational speed of the rotor are expediently between approximately 10 m/s and approximately 40 m/s, whereby generally the best sorting results are achieved with circumferential speeds of approximately 15 to approximately 30 m/s.

If the screen openings 38*a* of the screen 38 are bores, then their diameter is expediently approximately 1 mm to approximately 3.5 mm when the rotor is operated with a circumferential speed of approximately 10 to approximately 15 m/s. With higher circumferential speeds, smaller bores can be used; an inventive pressure sorter is expediently operated with rotor circumferential speeds of approximately 15 to approximately 40 m/s and then bores having a diameter of approximately 0.5 to approximately 1.5 mm are chosen for the screen openings. If the screen openings 38*a* are slots, then these ought to have a width of approximately 0.4 to approximately 0.6 mm at rotor circumferential speeds of approximately 10 to approximately 15 m/s; also in the case of slots, finer screen openings can be used at higher rotor circumferential speeds, and since rotor circumferential speeds of approximately 15 to approximately 40 m/s are preferred, slot-shaped screen openings with a width of approximately 0.1 mm to approximately 0.35 mm are recommended in this case.

The construction of the profiled elements 86*a*–86*d* or 88*a*–88*d* of the represented preferred embodiment results from FIGS. 3 and 4. Each of these profiled elements consists—when disregarding the rotor shell 84—of a strip 100 forming the first flank I, a curved metal sheet 102 forming the second flank II and two side walls 104, whereby with reference to FIG. 3, it ought to be noted that in this Figure, due to the sloped course of the first flanks I and with that the strips 100, the latter have not been cut vertically to their longitudinal extension but at an angle thereto. The cavities 106 of the profiled elements enclosed by the rotor shell 84, the strips 100, the metal sheets 102 and the side walls 104 are intended to be sealed so as to be impervious to liquid or filled with a filling material, as for example a foamed plastic, in order to prevent imbalances resulting in the rotor. The same applies to the cavity of the rotor body 82.

Finally, it is to be noted that the channels with the interior width $L_3$ are particularly clearly deducible from FIG. 4 and are designated with 200.

We claim:

1. A pressure sorter for fiber suspensions comprising:

a housing and a screen stationarily mounted therein, said screen being symmetrical to a screen axis and separating a supply chamber encircled by said screen from an accepts chamber lying outside said screen in said housing, a rotor having a circumferential periphery and being drivable about the screen axis by a motor, said rotor periphery together with an inlet side of the screen limiting the supply chamber in radial direction, an inlet for the fiber suspension to be treated communicating with a first axial end of the supply chamber and a rejects outlet communicating with a second axial end of the supply chamber, profiled elements are provided at said rotor periphery for generating positive and negative pressure pulses in the fiber suspension, each of said profiled elements having a first flank lying in front in rotational direction for driving the fiber suspension in rotational direction, as well as a second flank lying behind the first flank in a direction opposite to the direction of rotation for sucking back liquid from the accepts chamber through the screen and into the supply chamber, a rotor peripheral surface sector is provided between two profiled elements following one another in circumferential direction of the rotor for every axial section of the rotor acting on the screen, said profiled elements protruding in radial direction beyond said rotor peripheral surface sector and said sector being part of a peripheral surface area parallel to the screen inlet side as well as symmetrical to the screen axis, wherein, when measured in circumferential direction of the rotor, a maximum length of each profiled element is at least approximately equal to or greater than a minimum length of the rotor peripheral surface sector following in a direction opposite to the direction of rotation, whereas the minimum length of said rotor peripheral surface sector is at least 30% of an approximation of the maximum length of the profiled element lying in front thereof in the direction of rotation, and wherein the profiled elements are designed and arranged at the rotor periphery such that, when seen in the direction of the screen axis, the rotor peripheral surface sectors form through-channels between the profiled elements along the region of the rotor surrounded by the screen, and wherein the longitudinal direction of the first flank forms an acute angle with the axial direction.

2. The pressure sorter according to claim 1, wherein the longitudinal direction of the first flank is inclined with respect to the axial direction such that the first flank exerts on the fiber suspension present in the supply chamber an axial conveying effect towards the second axial end of the supply chamber.

3. The pressure sorter according to claim 1, wherein the rear edge of the second flank extends parallel to the screen axis.

4. The pressure sorter according to claim 1, wherein the first flank protrudes approximately in radial direction beyond the rotor peripheral surface sector lying in front of said flank.

5. The pressure according to claim 1, wherein the rotor has at least one first axial rotor circumferential surface section facing the first axial end of the supply chamber as well as at least one second axial rotor circumferential surface section adjacent to said first section in axial direction, wherein the first flanks of the profiled elements of the second section are offset backwardly with respect to the first flanks of the profiled elements of the first section in a direction opposite to the direction of rotation and the lengths of the profiled elements measured in circumferential direction of the rotor are dimensioned such that rotor peripheral surface sectors of the two axial sections adjacent to each other in axial direction overlap each other in the direction of rotation.

6. The pressure sorter according to claim 5, wherein the overlapping, measured in circumferential direction of the rotor, is at least approximately 50% of the length of one of the rotor peripheral surface sectors.

7. The pressure sorter according to claim 5, wherein the profiled elements in the first axial rotor circumferential section, measured in circumferential direction of the rotor, are shorter than in the second section.

8. The pressure sorter according to claim 5, wherein the height of the first flanks of the profiled elements, measured in radial direction, in the first axial rotor circumferential surface section is smaller than in the second section.

9. The pressure sorter according to claim 1, wherein the motor is a three-phase A.C. motor supplied by a frequency converter controllable with respect to its output frequency.

10. The pressure sorter according to claim 9, wherein the frequency converter is controllable by means of a measuring device for measuring the pressure difference between supply chamber and accepts chamber.

11. The pressure sorter according to claim 1, wherein the rotor has a circular cylindrical and hollow rotor body, the peripheral surface of said rotor body forming the rotor peripheral surface sectors, wherein the first flanks of the profiled elements are formed by strips attached to the peripheral surface of the rotor body and the second flanks by metal sheets which, in a side view, are arcuately curved, front edges of said sheets being attached to the strips and their back edges to the peripheral surface of the rotor body.

12. The pressure sorter according to claim 11, wherein the strips are welded onto the rotor body.

13. The pressure sorter according to claim 11, wherein the metal sheets are welded onto the strips and the rotor body.

14. The pressure sorter according to claim 11, wherein cavities formed by the peripheral wall of the rotor body and the profiled elements are sealed.

15. The pressure sorter according to claim 11, wherein cavities formed by the peripheral wall of the rotor body and the profiled elements are filled with a plastic.

16. The pressure sorter according to claim 15, wherein the plastic is a foamed plastic foamed in-situ.

17. The pressure sorter according to claim 1, wherein the profiled elements are solid plastic bodies.

18. The pressure sorter according to claim 17, wherein the front surface of the profiled elements lying in front in the direction of rotation is formed by a metal strip.

19. The pressure sorter according to claim 1, wherein the inlet side of the screen has a turbulence-generating profile.

20. The pressure sorter according to claim 1, wherein the length of the profiled elements measured in circumferential direction of the rotor is approximately 200 mm to 450 mm.

21. The pressure sorter according to claim 1, wherein the rotor is drivable by the motor with a circumferential speed of approximately 10 to 40 m/s.

22. The pressure sorter according to claim 21, wherein the rotor is drivable by the motor with a circumferential speed of approximately 15 to 30 m/s.

23. The pressure sorter according to claim 1, wherein for a rotor with a circumferential speed of approximately 10 to 15 m/s the screen has screen openings in the form of bores with a diameter of approximately 1 to 3.5 mm.

24. The pressure sorter according to claim 1, wherein for a rotor with a circumferential speed of approximately 15 to 40 m/s the screen has screen openings in the form of bores with a diameter of approximately 0.5 to 1.5 mm.

25. The pressure sorter according to claim 1, wherein for a rotor with a circumferential speed of approximately 10 to 15 m/s the screen has screen openings in the form of slots with a width of approximately 0.4 to 0.6 mm.

26. The pressure sorter according to claim 1, wherein for a rotor with a circumferential speed of approximately 15 to 40 m/s the screen has screen openings in the form of slots with a width of approximately 0.1 to 0.35 mm.

27. The pressure sorter according to claim 1, wherein the first flank of the profiled elements is designed such that the fiber suspension can be accelerated therewith in the direction of rotation up to the circumferential speed of the rotor.

28. The pressure sorter according to claim 5, wherein profiled elements adjacent to each other in axial direction directly adjoin each other in axial direction.

* * * * *